United States Patent [19]

Hoenig

[11] Patent Number: 4,602,450

[45] Date of Patent: Jul. 29, 1986

[54] FOREND STRUCTURE FOR PISTOL CONVERSION ASSEMBLY

[75] Inventor: George Hoenig, Boise, Id.

[73] Assignee: Pachmayr Gun Works, Inc., Los Angeles, Calif.

[21] Appl. No.: 733,380

[22] Filed: May 13, 1985

Related U.S. Application Data

[62] Division of Ser. No. 513,375, Jul. 13, 1983.

[51] Int. Cl.[4] ..... F41C 21/22

[52] U.S. Cl. ..... 42/75.02; 42/77

[58] Field of Search ..... 42/75 B, 77, 75 A, 75 C

[56] References Cited

U.S. PATENT DOCUMENTS

| | | | |
|---|---|---|---|
| 2,872,850 | 2/1959 | Davenport | 42/77 |
| 2,898,693 | 8/1959 | Ruger | 42/77 |
| 3,724,326 | 4/1973 | Day | 42/77 |

*Primary Examiner*—Charles T. Jordan
*Assistant Examiner*—Ted L. Parr
*Attorney, Agent, or Firm*—William P. Green

[57] ABSTRACT

A gun conversion assembly for application to the receiver of an automatic pistol having a handle containing a recess into which a magazine holding a series of rounds of ammunition is insertible, the conversion assembly including a barrel to be secured to the receiver, and a connector structure having a portion which is adapted to be located within the magazine recess in the receiver handle and which acts to secure the barrel rigidly to the receiver. The connector structure may extend downwardly through the recess to the bottom of the receiver handle and have elements at the lower end of the handle tightenable to progressively pull the receiver downwardly into tightly contacting engagement with the upper end of the receiver. The connector structure may also include an expansible combination of parts acting upon the exertion of downward force on the barrel retaining structure to expand laterally to an increased width in a relation tightly bearing against opposite side walls of the receiver recess and enhancing the overall connection between the barrel and receiver. A slide movably mounted to the receiver may be limited in its movement by a detent element carried by the slide and manually releasable to permit removal of the slide from the receiver while the barrel remains attached thereto.

11 Claims, 15 Drawing Figures

FOREND STRUCTURE FOR PISTOL CONVERSION ASSEMBLY

This is a division of application Ser. No. 6,513,375, filed July 13, 1983.

BACKGROUND OF THE INVENTION

This invention relates to improved pistol structures, and particularly to assemblies of parts for converting a pistol such as a Colt .45 caliber automatic pistol to a fixed barrel gun.

Automatic pistols of this type include a slide mounted to the upper side of the receiver of the gun for recoiling movement and acting to automatically eject a shell and feed the next successive round of ammunition into the firing chamber upon each rearward recoiling movement of the slide. The barrel is mounted for limited rearward and downward retraction after the gun is fired, and successive rounds of ammunition are fed to the barrel from a magazine inserted into a recess in the handle of the gun. A problem inherent in effecting conversion of such a gun to a fixed barrel arrangement is that of providing as rigid a connection as possible between the barrel and receiver of the gun for maximizing accuracy and insuring integrity of the pistol over an extended useful life.

SUMMARY OF THE INVENTION

The major purpose of the present invention is to provide an improved conversion arrangement for an automatic pistol of the above discussed general type, with the converted gun including a connection between the barrel and receiver of the gun having greater strength and rigidity than has been attained by prior devices, to allow optimum accuracy and extended reliability of the converted gun, and to do so with a very simple structure. Further, a gun converted by the apparatus of the present invention can be very easily returned to its original condition when desired for use as an automatic pistol. A particular feature of the invention resides in the fact that the conversion is attained without requiring any alteration of the main receiver or frame of the pistol, so that when the parts in converting the gun are detached and the original slide and other elements of the automatic pistol are reconnected to the receiver, the structure of the reconverted automatic pistol is exactly as it was before the conversion was made.

The advantages of the present arrangement are attained in large part by provision of a specially designed barrel assembly to be substituted for the original barrel of the automatic pistol, together with a unique connector structure which secures the barrel assembly to the receiver and is very effectively anchored to the receiver by extension of the connector parts downwardly from the barrel into the recess in the receiver which normally contains the ammunition magazine of the automatic pistol. Preferably, the connection includes a rod or other elongated element projecting downwardly through the recess in the handle portion of the receiver and to the lower end of the handle, and there connected to a bottom part which applies upward force to the handle to maintain the connection. A tightening element at the underside of the handle may by rotation tighten the connection to pull the barrel downwardly against the upper portion of the receiver.

The integrity of the connection may be further enhanced by forming the connector structure within the recess in the pistol receiver with an expansible portion which tends upon exertion of downward force on the connector structure to expand to an increased width condition in which it applies force in opposite lateral directions against two opposite side walls of the recess, to thus assure against any lateral shifting movement of the barrel and connector structure relative to the receiver after the connection has been completed. This expansible portion of the connector structure may include two camming elements which are automatically cammed laterally relative to one another upon tightening of the connection between the parts to bear against the side walls of the recess in the receiver.

The converted gun may include a slide mounted for front to rear movement relative to the barrel and receiver, and preferably carrying a manually actuated bolt for closing the rear end of the receiver during firing.

An additional feature of the invention relates to the provision of an element to be received at the underside of the barrel, and vertically between the barrel and receiver, at a location forwardly of the main connection between these parts. This element is desirably attached to the receiver by a projection extending rearwardly from the element and containing an opening through which a pin connected to the receiver extends. This pin may be a portion of the slide stop member normally present in an automatic gun of the discussed type.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENTS

Figures 1, 2:
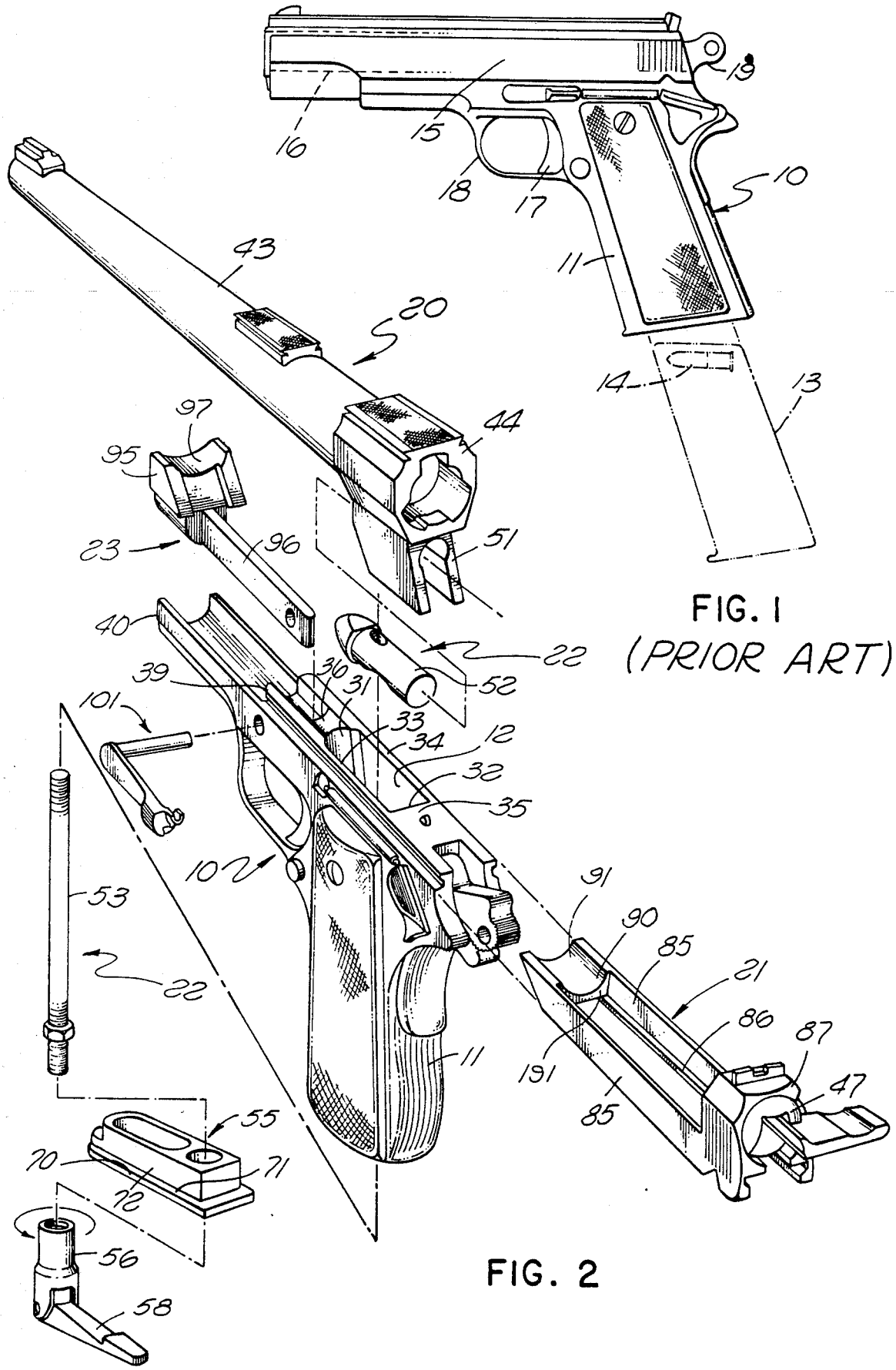
FIG. 1 (PRIOR ART)
FIG. 1 is a side elevational view, partially in section, of a Colt Model "O" .45 caliber automatic pistol as it appears prior to conversion in accordance with the present invention.
FIG. 2 is an exploded perspective view showing the receiver of the FIG. 1 pistol after detachment of the barrel, slide, and other related parts therefrom, and showing also in FIG. 2 in conjunction with the receiver the parts which are utilized for converting the gun pursuant to the invention.

The conventional Colt Model "O" .45 caliber automatic pistol which is illustrated in FIG. 1 as it appears before conversion in the manner contemplated by the present invention includes a main receiver or frame 10 having a handle portion 11 containing a magazine recess 12 within which a magazine 13 containing a series of rounds of ammunition 14 is received. Recess 12 extends generally vertically within handle portion 11 of the receiver, and is open at its lower end to allow the magazine to be inserted upwardly into the recess from the broken line position of FIG. 1.

Figures 3, 3A, 4, 5:
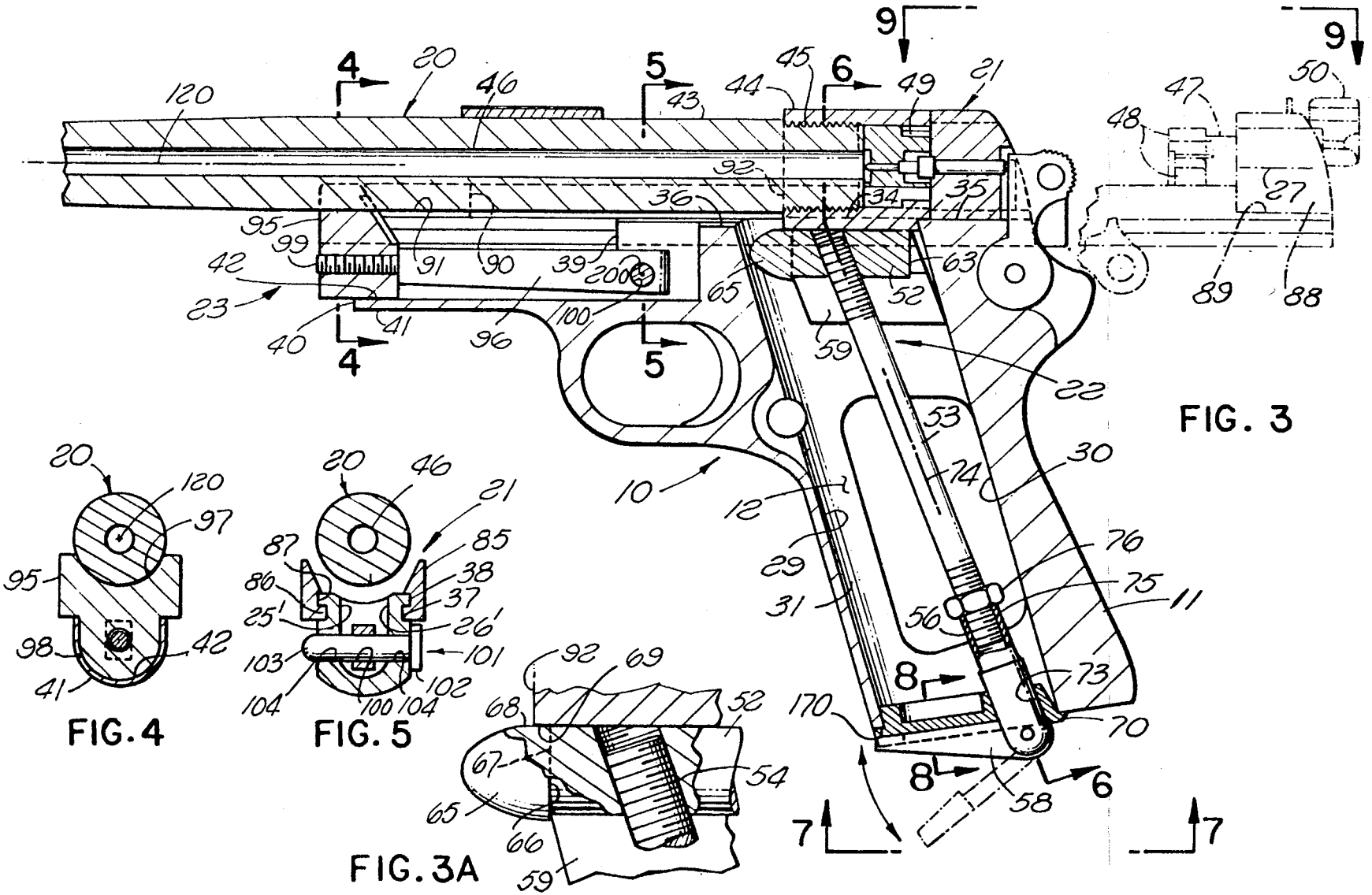
FIG. 3 is a vertical front to rear section through the converted gun.
FIG. 3A is an enlargement of a portion of FIG. 3.
FIGS. 4, 5 and 6 are vertical sections taken on lines 4—4, 5—5 and 6—6 respectively of FIG. 3.

At its upper side, receiver 10 carries a slide 15 which is mounted to the receiver for front to rear recoiling movement when a round is fired within barrel 16. In the standard Colt automatic pistol, the barrel recoils slightly rearwardly and downwardly when the round is fired. The gun is fired by a trigger 17 within a trigger loop portion 18 of the receiver, with the trigger acting to release the hammer 19 to fire the round. In FIG. 3, the receiver 10 is shown with the slide 15, barrel 16, magazine 13 and other related parts removed therefrom, and with the elements of a conversion kit embodying the present invention attached to the receiver. As illustrated in exploded form in FIG. 2, these parts include a barrel assembly 20, a slide 21, connector structure 22 for attaching the barrel assembly rigidly to the receiver, and a unit 23 received between a forward portion of the receiver and the underside of the barrel.

The magazine receiving recess 12 in handle portion 11 of receiver 10 extends along an axis 24 which may be inclined to advance forwardly as it advances upwardly. The recess is of essentially uniform cross-section transversely of axis 24, and is defined at its opposite sides by two parallel side walls 25 and 26 having parallel vertical inner wall surface 27 and 28 which are disposed parallel to axis 24 of the magazine recess and axis 120 of barrel 20. The front and rear of the recess are defined by transverse forward and rear walls 29 and 30 of the receiver, with the former of these having a curving wall surface 31 at the front of the recess, and with the rear transverse wall 30 having a planar surface 32 at the back of the magazine recess. At the upper ends of walls 25, 26 and 30, the receiver has a planar horizontal upper surface with portions 33 and 34 extending in a front to rear direction along opposite sides of the magazine recess, and with a portion 35 of the same upper horizontal surface extending transversely across the back of the recess. The upper surface 36 of front wall 29 of the recess may be curved concavely and partial cylindrically as illustrated in FIG. 2. At their outer sides, side walls 25 and 26 of the receiver form horizontally extending grooves 37 and ribs 38 (FIG. 6) which extend parallel to axis 27 of the barrel to guide slides 15 and 21 for a front to rear movement relative to the receiver. As seen in FIG. 5, the receiver at a location forwardly of transverse portion or wall 29 may form forward continuations 25' and 26' of the two side walls 25 and 26 of the magazine recess, with grooves 37 and ribs 38 continuing forwardly to the plane of FIG. 5 and a short distance forwardly therebeyond. Between the locations 39 and 40 of FIG. 3, the receiver may have a forward portion 41 containing an upwardly facing approximately semi-cylindrical recess 42 of the cross sectional configuration illustrated in FIG. 4.

The barrel assembly 20 of the conversion kit may be formed sectionally to include a barrel proper 43 and a part 44 secured rigidly to the rear end of barrel 43 by a threaded connection 45. Alternatively, the two elements 43 and 44 may if desired be formed integrally of a single piece of metal. A projectile fired by the gun is discharged through bore 46 in the barrel. During firing, the rear end of the barrel assembly is closed by a bolt 47 carried by the rear portion of slide 21. This bolt may be of conventional construction, having a number of circularly spaced lugs 48 engageable with mating lugs 49 formed within part 44 to rigidly retain the bolt in barrel closing and sealing position within part 44. The bolt is actuable between active and released positions by manually turning it relative to the slide about axis 27 by means of an actuating handle 50 and then pulling it rearwardly.

Figure 6:
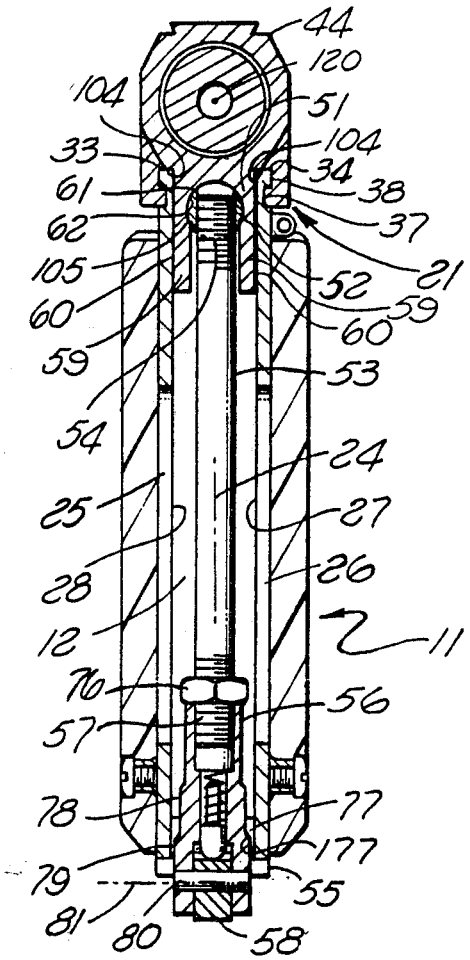
Figure 7:
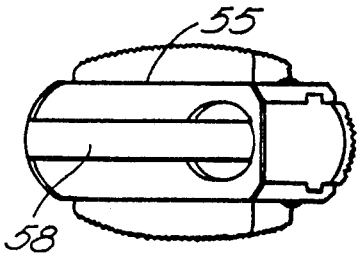
FIG. 7 is a bottom view of the handle of the converted gun, taken on line 7—7 of FIG. 3.
Figure 8:
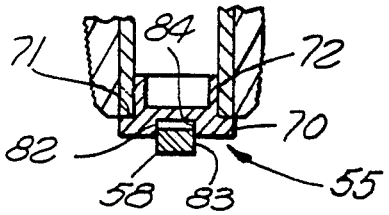
FIG. 8 is a fragmentary vertical section taken on line 8—8 of FIG. 3.
Figure 10:
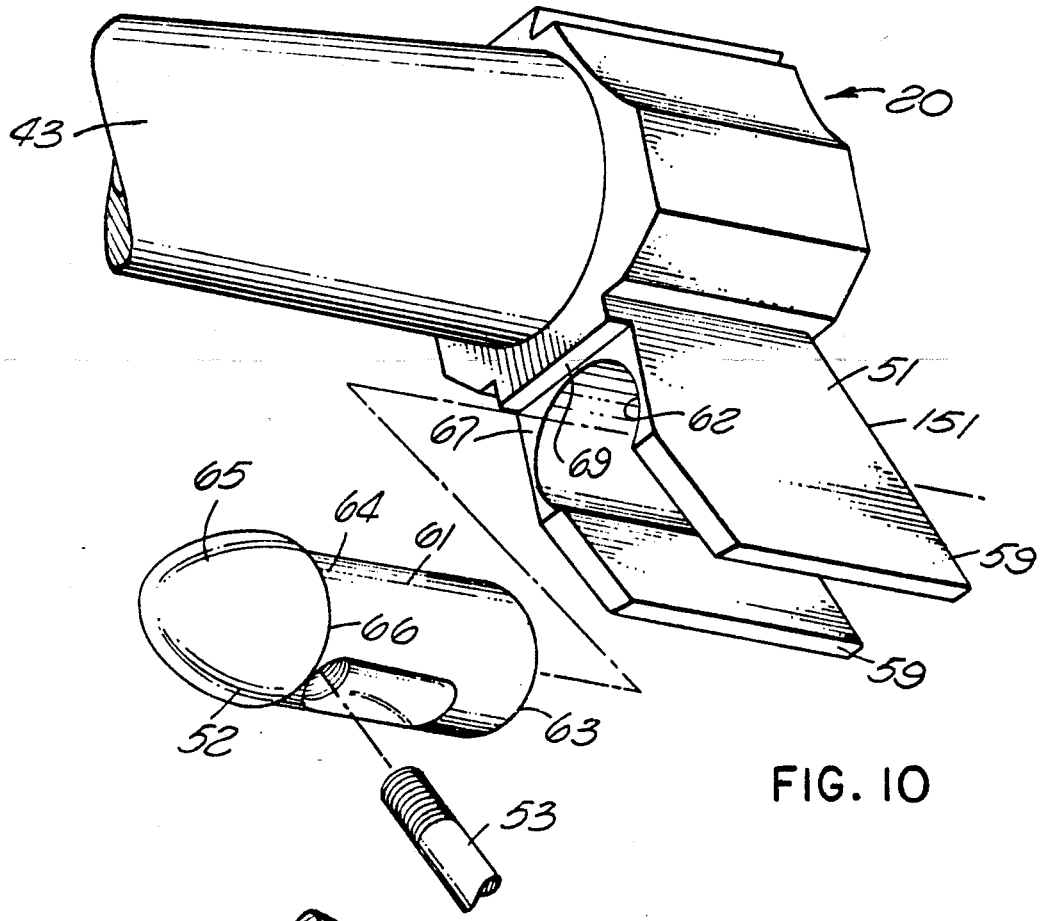
FIG. 10 is a perspective view of the rear portion of the barrel of the FIG. 3 device and related parts.
Figure 14:
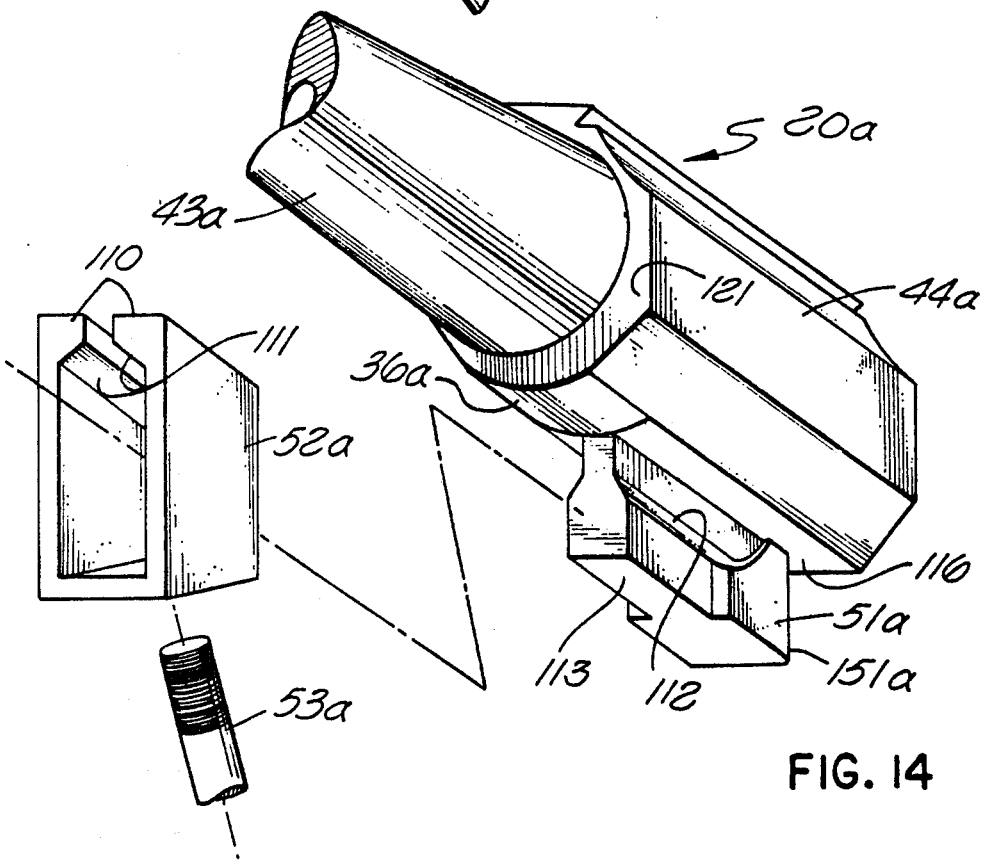
FIG. 14 is an exploded perspective view similar to FIG. 10 but showing the variational arrangement of FIG. 11.
Figure 11:
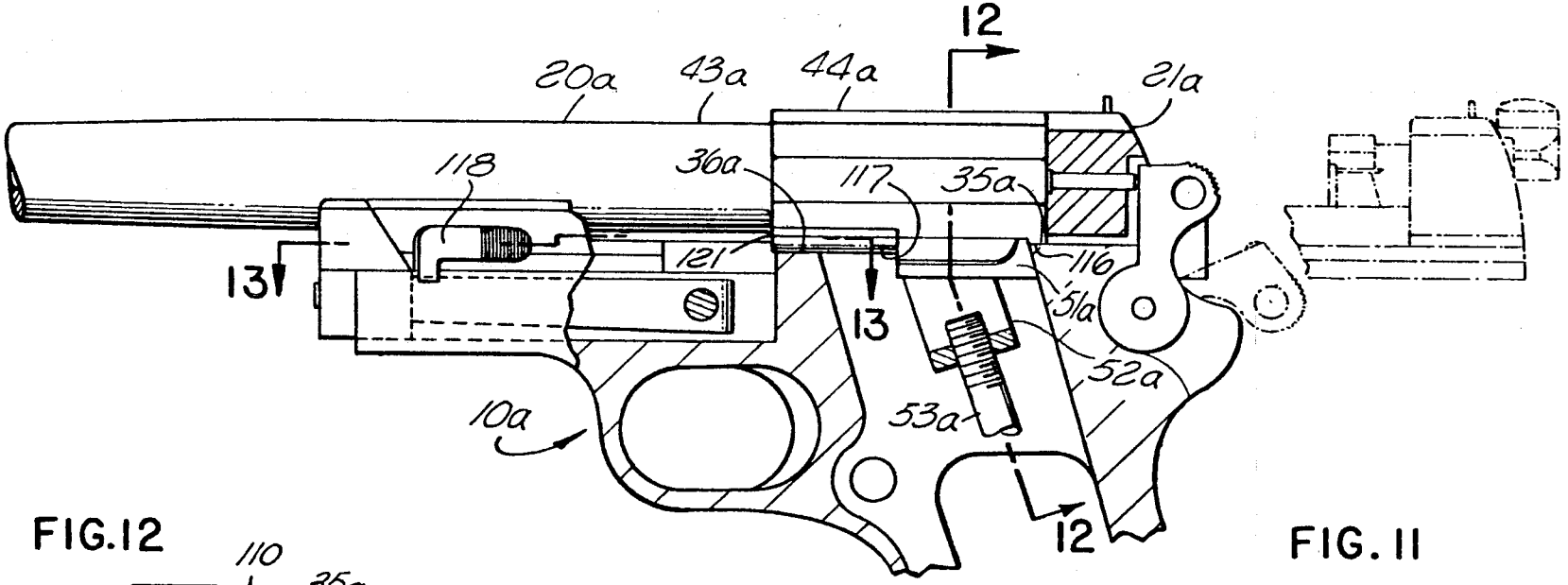
FIG. 11 is a fragmentary front to rear sectional view similar to a portion of FIG. 3, but showing a variational form of the invention.
Figure 13:
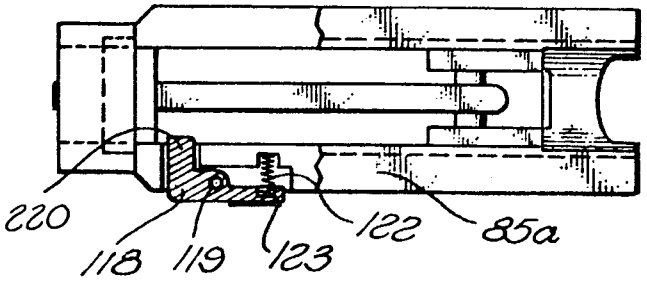
FIG. 13 is a fragmentary horizontal section taken on line 13—13 of FIG. 11.

The connector structure 22 for securing the barrel assembly to the receiver includes an assembly of parts which project downwardly from the barrel assembly into and through magazine recess 12 in receiver 10 to clamp the rear element 44 of the barrel assembly downwardly against the upper surface of the receiver. These parts of the connector structure include a projection 51 secured rigidly to part 44 of the barrel assembly and preferably formed integrally therewith and extending downwardly into the upper end of the magazine recess. Coacting with projection 51, the connector structure includes a connecting element 52, an elongated rod 53 threadedly connected at 54 to element 52, a bottom plate 55 extending across the lower end of the magazine recess in the receiver, a member 56 threadedly connected at 57 to the lower end of rod 53, and an actuating handle 58 for turning part 56. Projection 51 is bifurcated (FIG. 10) to form two spaced downwardly projecting walls 59 having outer planar surfaces 60 engaging and adapted to bear lightly against side wall surfaces 27 and 28 of the magazine recess in receiver 10. Element 52 is received between the two walls 59, and is configured to exert downward force on the walls and at the same time cam them laterally apart and against surfaces 27 and 28. For this purpose, element 52 has a portion with an externally cylindrical surface 61 engaging a correspondingly cylindrical surface 62 formed within projection 51 at the inner sides of walls 59. The cylindrical surface 61 of element 52 extends from one end 63 of that part to the location 64 of FIG. 3, with the element 52 having a slightly enlarged convexly rounded forward portion 65 beyond the location 64. Element 52 is inserted rearwardly into the space between walls 59 of projection 51, to the FIG. 3 position in which a transverse essentially annular shoulder 66 on the forward enlarged portion 65 of element 52 engages a forward vertical planar surface 67 of projection 51. A small upper horizontal flat surface 68 may be formed on the enlarged portion 65 of element 52 to engage a flat horizontal undersurface 69 formed on projection 51 and thereby retain element 52 against rotation from a position in which the axis of its threads 54 lies in a proper vertical plane for connection to rod 53. The lower portions of walls 59 of projection 51 are spaced apart sufficiently to allow the rod 51 to project downwardly therebetween as seen in FIG. 6.

Bottom plate 55 is shaped to extend across and close the lower end of magazine recess 12 in receiver 10, and has a peripheral flange 70 extending along the opposite sides, front and rear of bottom plate 55 to form upwardly facing shoulder surfaces 71 engageable upwardly against the bottom edge surface 170 of the receiver about recess 12 in a manner applying upward force to the receiver and limiting upward movement of bottom plate 55 relative to the receiver. Above flange 70, the bottom plate may have a portion 72 projecting upwardly into the recess and fitting closely therein to locate plate 55 against horizontal movement relative to the receiver handle.

Part 56 extends upwardly through an inclined passage 73 formed in bottom plate 55, with that passage being disposed at an inclination corresponding to that of axis 74 of rod 53. Rod 53 is threadedly connected into a passage in part 56 at 75, and may be locked in a desired setting relative to part 56 by a jam nut 76 threadedly connected onto the rod and tightenable against the upper end surface of part 56. An annular shoulder 77 formed on part 56 between an externally cylindrical portion 78 and a larger diameter externally cylindrical lower portion 79 of part 56 engages a corresponding annular shoulder 177 on bottom plate 55 to apply upward force from part 56 to plate 55 when part 56 and rod 53 are turned relative to element 52. Handle part 58 is pivotally connected to part 56 by a transverse pin 80 for relative pivotal movement about the axis 81 of the pin between the full line locking position of FIG. 3 and the broken line released position of that figure. In the locking position of FIG. 3, handle 58 is received within a groove 82 formed in the underside of bottom plate 55 and extending in a front to rear direction relative to the gun, with the vertical side surfaces 83 of the handle engaging vertical side walls 84 of the groove to lock the handle and thus part 56 against rotation about axis 74 of rod 53.

Figure 9:
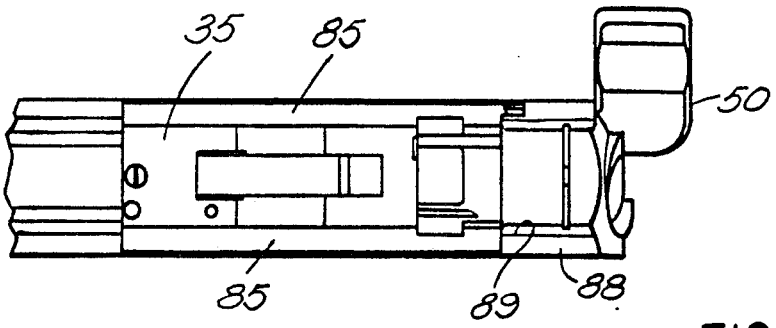
FIG. 9 is a fragmentary plan view taken on line 9—9 of FIG. 3, and showing the slide and bolt in their retracted positions.

Slide 21 may be formed of a single piece of metal having two parallel side rail portions 85 received at the outer sides of the two side walls 25 and 26 of receiver 10 and having ribs 86 adapted to project into grooves 37 of the receiver, and grooves 87 adapted to receive ribs 38 of the receiver in a manner guiding slide 21 for front to rear sliding movement relating to the receiver between the active firing position of FIG. 3 in which bolt 47 closes the rear end of the barrel assembly and the rearwardly retracted position of FIG. 9 in which the chamber is open for removal of a spent shell from the rear end of the barrel and loading of another round thereinto. The bolt is mounted to the slide by reception within a portion 88 of the slide interconnecting side rails 85 at their rear ends, this portion 88 containing a passage 89 within which the bolt is carried for limited rotary movement relative to portion 88 about axis 27. At their forward ends, the side rails 85 of the slide are connected together by a transverse portion 90 of the slide, having an upper surface 91 curved cylindrically in correspondence with the undersurface of barrel 43 to engage that undersurface and move slidably relative to the barrel. In the rearmost position of the slide (FIG. 9), a vertical rear shoulder surface 191 on portion 90 of the slide engages a vertical forward surface 92 on the rear part 44 of the barrel assembly to prevent further rearward movement of the slide.

The unit 23 at the underside of the barrel includes a forward member 95 and a connector part 96 rigidly secured thereto. Part 95 has the vertical sectional configuration illustrated in FIG. 4, with an upper partial cylindrical surface 97 curved in correspondence with and adapted to engage the external surface of barrel 43. At its undersurface, part 95 has an essentially semi-circularly curved surface 98 dimensioned to fit closely within the previously mentioned curved surface 42 formed in the forward portion of the receiver to locate part 95 relative thereto. The element 96 may be rigidly connected to part 95 in any convenient manner, as by a threaded connection at 99. Element 96 projects rearwardly from the part 95, and contains a cylindrical opening 100 whose axis 200 extends horizontally and lies within a vertical plane disposed transversely of axis 120 of the barrel. The usual slide stop member 101 which is present in the standard automatic pistol as represented in FIG. 1 interfits with this opening 100 in unit 23 to lock that unit in fixed position relative to the receiver. As seen in FIG. 5, the slide stop has a portion 102 received adjacent the outer surface of the receiver and carrying a cylindrical pin portion 103 which extends through and is a close fit within circular opening 100 in unit 23 and in two aligned openings 104 formed in the opposite side portions of the receiver.

In converting the gun of FIG. 1 to the condition of FIG. 3, the first step is to remove the slide, barrel, etc, of the original gun from receiver 10, after which unit 23 may be positioned in the forward portion of the receiver in its FIG. 3 position and locked therein by insertion of pin 103 of slide stop 101 through the opening 100 in member 96 of unit 23. With the hammer 19 of the gun cocked rearwardly, slide 21 may then be inserted forwardly relative to the receiver, with the ribs and grooves 37, 38, 86 and 87 interfitting as discussed. Connecting element 52 may then be inserted rearwardly between walls 59 of projection 51 at the underside of barrel assembly 20, after which the barrel assembly can be moved downwardly relative to the receiver to move projection 51 and element 52 downwardly into the upper end of magazine recess 12. Rod 53 can then be inserted upwardly through the opening in bottom plate 55, with the rod connected to part 56 as illustrated in FIG. 3, and this entire assembly can be moved upwardly into the magazine recess to bring the upper threaded end of the rod into engagement with the threaded bore in connecting element 52. Part 56 and rod 53 are then turned by rotation of handle 58, with the handle in its broken line position of FIG. 3, so that by virtue of the threaded connection 54 between the rotating rod 53 and the non-rotating connecting element 52 the rod and part 56 are progressively pulled upwardly relative to the receiver. This upward force is applied to bottom plate 55 by part 56, with the rotation being continued until the bottom plate is in tight engagement with the lower end of the recess, and rear part 44 of the barrel assembly is pulled tightly downwardly against the upper horizontal surfaces 33 and 34 of the receiver. To attain effective and rigid engagement between the barrel assembly and receiver, part 44 of the barrel assembly has two horizontal planar surfaces 104 at opposite sides of the magazine recess for engaging and abutting tightly downwardly against magazine surfaces 33 and 34.

As the connecting element 52 is pulled downwardly, the inclined disposition of the engaging cylindrical surfaces of element 52 and walls 59 of projection 51 (at 105 in FIG. 6) causes these surfaces to function as camming surfaces acting to progressively force walls 59 relatively apart to an increased width condition in which the outer surfaces 60 of walls 59 bear very tightly against side wall surfaces 27 and 28 of the magazine recess to enhance the effectiveness of the rigid interconnection between the barrel assembly and receiver.

When the rod 53 and connected parts have been turned to a position in which the desired rigid connection between the barrel assembly and receiver has been attained, handle 58 is swung upwardly from its broken line position of FIG. 3 to its full line position of that figure in which the handle is received within groove 82 and bottom plate 55 to lock the parts in that adjusted position. The threaded connection between rod 53 and part 56 is preadjusted to a condition in which the handle will in the properly tightened condition of the parts be aligned vertically with and move upwardly into groove 82, with jam nut 76 being utilized for locking the rod and part 56 in this desired relative setting.

Since the conversion of the gun as discussed above does not alter the construction of any of the parts of the original pistol, the gun may at any time be easily reconverted to its original condition by removal of the parts of the conversion kit and reassembly of the standard parts on the receiver.

Figure 12:
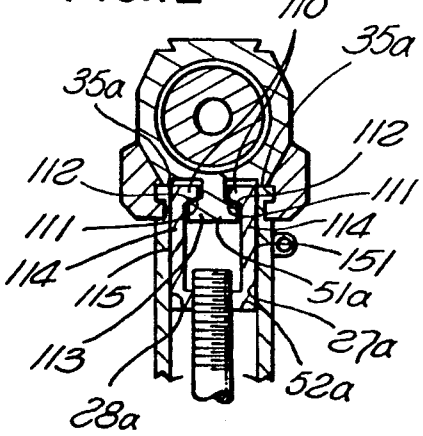
FIG. 12 is a fragmentary essentially vertical transverse section taken on line 12—12 of FIG. 11.

The variational form of the invention illustrated in FIGS. 11 through 14 is essentially the same as that of FIGS. 2 through 10 except with regard to the manner of connection of the barrel assembly 20*a* to the receiver, and the construction of the forward portion of slide 21*a*. In FIGS. 11 through 14, the rear part 44*a* of the barrel assembly, which corresponds to part 44 of the first form of the invention and is threadedly connected to the rear end of the barrel proper 43*a*, has a projection 51*a* at its underside which engages a connecting element 52*a* in camming relation. Rod 53*a* may be the same as the rod 53 of the first form of the invention, and be connected at its lower end to elements identical with those represented at 55, 56, 58 and 76 for engaging the lower end of the receiver 10*a* and applying upward force thereto. As seen in FIG. 12, element 52*a* is of U-shaped configuration, for receiving projection 51*a* therebetween, and is shaped at its upper end to have two portions 110 projecting toward one another and having inclined camming undersurfaces 111 engageable with correspondingly inclined surfaces 112 formed on an enlarged lower portion 113 of projection 51*a*, so that part 52 can pull projection 51 and the magazine downwardly against the upper edge of the magazine, with the camming surfaces 111 and 112 acting to spread the opposite side portions 114 of part 52*a* relatively laterally apart upon exertion of such downward force, causing the parallel vertical outer planar surfaces 115 of portions 114 to bear tightly against the side wall surfaces 27*a* and 28*a* of the magazine recess in the receiver and thereby assure rigid interconnection of the barrel assembly and receiver. When the parts have been pulled to a properly tightened condition, the handle 58 at the lower end of rod 53*a* can be swung to locking position as in the first form of the invention.

In the form of the invention illustrated in FIGS. 11 through 14, the downward force exerted by part 44*a* of the barrel assembly on the receiver is applied to the receiver through surfaces on part 44*a* and the receiver engaging in front of and behind the magazine recess 12*a*. These surfaces include a downwardly facing horizontal surface 116 formed on the rear portion of part 44*a* and extending across that rear portion of the part behind projection 51*a* and engaging downwardly against upwardly facing surface 35*a* on the receiver. In front of projection 51*a*, part 44*a* has a curved surface 117 engaging the concavely curved upwardly facing surface 36*a* formed on the receiver at that location. In this form of the invention, the part 44*a* preferably does not contact the upper edge surfaces extending along opposite sides of the magazine recess and corresponding to surfaces 33 and 34 referred to in describing the first form of the invention.

Slide 21*a* of the second form of the invention may be the same as the slide used in the first form of the invention except for deletion of the transversely extending portion 90 at the front of the slide. Such omission of this portion allows the slide to be removed rearwardly from the receiver while the barrel remains attached thereto. In order to limit this rearward movement except when removal is desired, one of the side rails 85*a* of the slide carries a detent element 118, which is connected to the side rail by a pin 119 for pivotal movement about a vertical axis relative to the side rail, and which has a portion 120 projecting laterally inwardly beyond the inner surface of the side rail to a position for engagement with forwardly facing shoulder 121 on part 44*a* of the barrel assembly to prevent rearward movement of the slide beyond the position in which portion 120 engages shoulder 121. A spring 122 yieldingly holds the detent element in its active position for limiting rearward movement of the slide, and the detent can be pivoted to a position in which its portion 120 will not engage shoulder 121 and can move rearwardly past that shoulder by manual inward depression of a portion 123 of the detent element against the tendency of spring 122.

In assembling the arrangement of FIGS. 11 through 14, unit 23 is first connected to the receiver in the same manner as discussed in connection with the first form of the invention, after which barrel assembly 43*a* can be moved into position with its projection 51*a* extending downwardly into the magazine recess in the receiver, and with element 52*a* connected to projection 51*a*. Rod 53*a* and its connected parts may then be attached to element 52*a*, with the rod and connected parts being tightened to pull part 44*a* of the barrel assembly tightly downwardly against the receiver surfaces in front of and behind the magazine recess, with simultaneous automatic camming of U-shaped part 52*a* to an increased width condition bearing tightly against the opposite side walls of the magazine recess and attaining a highly effective overall rigid connection between the barrel and receiver. The slide may then be inserted forwardly onto the receiver, with the side rails 85*a* of the slide moving along opposite sides of the barrel assembly and slideably engaging the ribs and grooves of the receiver, and with the detent element 118 being deflected to pass part 44*a* and move to a position in front of that part and then automatically being returned by its spring 122 to a position thereafter preventing rearward movement of the slide beyond the discussed limiting position except when and if the detent element is intentionally released for removal of the slide.

In both forms of the invention, recoiling forces are transmitted from the barrel assembly to the receiver by engagement of generally vertically extending shoulders on these parts. In the first form of the invention, these recoiling forces are transmitted from an inclined rear surface 151 on projection 51 to the correspondingly inclined planar rear wall surface 32 of magazine recess 12. As will be apparent from FIG. 3, the inclination of these engaging surfaces tends to cam the barrel downwardly relative to the receiver under the influence of recoiling forces in a manner assuring maintenance of a rigid connection between the parts upon firing. In the second form of the invention, the recoiling forces are similarly transmitted from an inclined rear planar surface 151*a* of projection 51*a* to the correspondingly inclined rear wall of the magazine recess.

While certain specific embodiments of the present invention have been disclosed as typical, the invention is of course not limited to these particular forms, but rather is applicable broadly to all such variations as fall within the scope of the appended claims.

I claim:

1. For use with a pistol receiver having opposite side walls containing aligned openings through which a connector pin can extend, apparatus comprising:

a barrel to be located at the upper side of the receiver;

an element to be located above said receiver and beneath the barrel and which contains an upwardly facing recess within which a lower portion of said barrel is receivable;

said element having a connector portion receivable between said opposite side walls of the receiver and containing an opening through which said pin can extend to connect said element to the receiver; and a connection for attaching a rear portion of said barrel rigidly to the receiver at a location rearwardly of said pin and said connector portion of said element through which the pin extends.

2. Apparatus as recited in claim 1, in which said connector portion of said element includes an elongated projection extending rearwardly and containing said opening near a rear end thereof.

3. Apparatus as recited in claim 1, in which said connector portion of said element is elongated in a front to rear direction and contains said pin receiving opening near a rear end thereof, said element having an additional portion attached to a forward end of said elongated connector portion and containing said upwardly facing recess within which the barrel is receivable.

4. Apparatus as recited in claim 1, in which said upwardly facing recess in said element has an essentially cylindrically curved surface engageable with a correspondingly curved undersurface of the barrel.

5. Apparatus as recited in claim 1, in which said element has a cylindrically curved undersurface engageable with a correspondingly curved surface formed in the receiver between said side walls thereof.

6. For use with a pistol receiver having an upwardly facing recess with two side walls containing aligned openings, and a slide stop member having a pin which is adapted to extend through said openings and across said recess and which is pivotable about an axis extending longitudinally of the pin; conversion apparatus including:

a barrel adapted to be received at the upper side of the receiver;

an element to be located above said receiver and beneath said barrel and which contains an upwardly facing recess within which a lower portion of said barrel is receivable;

said element having a connector portion receivable at least partially within said recess in the receiver and between said side walls thereof and containing an opening through which said pin can extend to connect said element to the receiver; and a connection for attaching a rear portion of said barrel rigidly to the receiver at a location rearwardly of said pin and said connector portion of said element through which the pin extends.

7. Conversion apparatus as recited in claim 6, in which said connector portion of said element is elongated in a front to rear direction and contains said opening near a rear end thereof, said element having an additional portion attached to a forward end of said connector portion and containing said upwardly facing recess within which a lower portion of said barrel is receivable.

8. Conversion apparatus as recited in claim 7, in which said receiver has an essentially cylindrically curved upper surface within said recess in the receiver, and said additional portion of said element has a correspondingly curved undersurface engaging said curved upper surface of the receiver; said barrel having an essentially cylindrically curved undersurface, and said additional portion of said element having a similarly curved upper surface engaging said undersurface of the barrel.

9. The combination comprising:

a pistol receiver having opposite side walls containing aligned openings;

a connector pin extending through said openings;

a barrel located at the upper side of said receiver;

an element located above said receiver and beneath the barrel and containing an upwardly facing recess within which a lower portion of said barrel is receivable;

said element having a connector portion received between said opposite side walls of the receiver and containing an opening through which said pin extends to connect said element to the receiver; and a connection attaching a rear portion of said barrel rigidly to the receiver at a location rearwardly of said pin and said connector portion of said element through which the pin extends.

10. A converted gun comprising:

a pistol receiver having an upwardly facing essentially semi-cylindrical recess with two side walls containing aligned openings;

a slide stop member having a pin which extends through said openings and across said recess and which is pivotable about an axis extending longitudinally of the pin;

a barrel formed separately from said receiver and received at the upper side thereof;

an element having a first portion located above said receiver and beneath said barrel and containing an upwardly facing recess within which a lower portion of said barrel is received;

said first portion of said element having an undersurface curved essentially semi-cylindrically and fitting closely within said essentially semi-cylindrical recess in the receiver;

said element having an elongated connector portion attached at a forward end to said first portion of said element and projecting rearwardly therefrom within said recess in the receiver and between said side walls thereof and containing an opening through which said pin extends to attach said element to the receiver; and a connection attaching a rear portion of said barrel rigidly to the receiver at a location rearwardly of said pin.

11. A converted gun as recited in claim 10, in which said barrel has an essentially cylindrically curved undersurface, and said first portion of said element has an upper surface curved essentially cylindrically in correspondence with and engaging said undersurface of the barrel.

* * * * *